US006666704B2

(12) United States Patent
Rodney, Sr.

(10) Patent No.: US 6,666,704 B2
(45) Date of Patent: Dec. 23, 2003

(54) EASILY REMOVABLE AND ATTACHABLE MECHANICAL/ELECTRICAL COUPLING

(75) Inventor: Michael J. Rodney, Sr., Venice, FL (US)

(73) Assignee: Baker Electronics Inc., Sarasota, FL (US)

( * ) Notice: Subject to any disclaimer, the term of this patent is extended or adjusted under 35 U.S.C. 154(b) by 0 days.

(21) Appl. No.: 10/022,829

(22) Filed: Dec. 20, 2001

(65) Prior Publication Data

US 2002/0090855 A1 Jul. 11, 2002

Related U.S. Application Data

(60) Provisional application No. 60/257,152, filed on Dec. 22, 2000.

(51) Int. Cl.[7] ..... H01R 13/627

(52) U.S. Cl. ..... 439/352; 439/372

(58) Field of Search ..... 439/352, 131, 439/132, 310, 157, 152, 159, 160, 372, 153, 347, 342, 343

(56) References Cited

U.S. PATENT DOCUMENTS 5,271,590 A 12/1993 Rosen ..... 248/222.1
5,611,513 A 3/1997 Rosen ..... 248/222.1
5,674,086 A * 10/1997 Hashizawa et al. ..... 439/310
5,850,997 A 12/1998 Rosen ..... 248/222.1
5,873,737 A * 2/1999 Hashizawa et al. ..... 439/39
6,070,843 A 6/2000 Rosen ..... 248/278.1

* cited by examiner

*Primary Examiner*—Ross Gushi

(57) ABSTRACT

An apparatus is provided for removably mounting and electrically connecting electronic equipment through a plug to a permanently mounted powered receptacle that allows removal of power from the equipment, such as a monitor, attached to it without removal of the plug/monitor assembly from the receptacle. Embodiments include a plug portion inside of which is slidably mounted a connector housing carrying an electrical connector half. The plug further comprises a lever for sliding the housing between an engagement position, in which the electrical connector half engages a mating electrical connector half in a receptacle, and a non-engagement position where the connector halves are apart. The plug has retractable nubs on its exterior which are biased to engage grooves in the receptacle to retain the plug in the receptacle by a spring-like backing plate attached to the nub disposed in the interior of the plug near the walls of the slidable housing. When the housing is in the non-engagement position, the nubs and their backing plates are allowed to retract with a modest force to allow the plug to be engaged with or removed from the receptacle. Thus, the plug can be inserted into the receptacle without engaging the electrical connector halves, and the lever can thereafter be operated to engage (or disengage) the electrical connector halves when the plug and receptacle are engaged, without removing the plug from the receptacle.

17 Claims, 7 Drawing Sheets

EASILY REMOVABLE AND ATTACHABLE MECHANICAL/ELECTRICAL COUPLING

CROSS REFERENCE TO RELATED APPLICATION

This application claims priority from U.S. Provisional Application Ser. No. 60/257,152 filed Dec. 22, 2000.

FIELD OF THE INVENTION

The present invention relates to couplings for mechanically supporting and electrically connecting electronic devices. The present invention has particular applicability to quick connect/disconnect devices for electronic equipment designed for use at one of multiple possible locations.

BACKGROUND ART

Certain electronic equipment, such as flat-panel monitors used in airplanes for business and entertainment purposes, is removably mounted so that it can be stowed for take-off and landing, and is electrically attached to a powered receptacle as desired by the user. Typically, an airplane is equipped with several such powered receptacles at different locations. To facilitate connection and disconnection of such electronic equipment, a device known as a "hot plug arm" has been employed which comprises a plug that mates with the permanently mounted powered receptacles to electrically connect the equipment and to provide mechanical support for the equipment. Hot plug arms typically also comprise a pivotable arm attached to the plug to allow the user to adjust the viewing position of the monitor.

Conventional hot plug arms provide simultaneous electrical and mechanical connections to the powered receptacle; in other words, when the plug of the hot plug arm is inserted into the receptacle so that the arm and the equipment mounted to it is securely supported, an electrical connector in the plug mates with a corresponding connector in the receptacle at the same time. Consequently, electrical power cannot be disconnected while the hot plug arm is plugged into the receptacle and is mechanically supporting the monitor. Since monitors typically do not have an on/off switch, this situation is problematic because it does not allow the user the flexibility of turning off the monitor without removing it from the receptacle and stowing it. To overcome this problem, a non-standard monitor with an on/off switch is sometimes provided. However, the limited availability and extra cost of such monitors renders this solution less than ideal.

There exists a need for a hot plug arm capable of supporting a monitor without providing power to the monitor.

SUMMARY OF THE INVENTION

An advantage of the present invention is a hot plug arm that allows removal of power from a piece of equipment, such as a monitor, attached to it without removal of the hot plug arm/monitor assembly from the receptacle into which it is plugged.

According to the present invention, the foregoing and other advantages are achieved in part by an apparatus comprising a first electrical connector portion; a second electrical connector portion for engaging with the first electrical connector portion to establish an electrical connection; a receptacle for mounting the first electrical connector portion; and a plug for engaging the receptacle such that the receptacle and plug form a substantially rigid coupling when engaged. The plug comprises a housing for mounting the second electrical connector portion, and the housing is movable from a first position where the first and second electrical connector portions are disengaged to a second position where the first and second electrical connector portions are engaged.

Additional advantages of the present invention will become readily apparent to those skilled in this art from the following detailed description, wherein only the preferred embodiment of the present invention is shown and described, simply by way of illustration of the best mode contemplated for carrying out the present invention. As will be realized, the present invention is capable of other and different embodiments, and its several details are capable of modifications in various obvious respects, all without departing from the invention. Accordingly, the drawings and description are to be regarded as illustrative in nature, and not as restrictive.

BRIEF DESCRIPTION OF THE DRAWINGS

Reference is made to the attached drawings, wherein elements having the same reference numeral designations represent like elements throughout, and wherein.

DESCRIPTION OF THE INVENTION

Conventional hot plug arms for connection to a powered receptacle do not allow power to be disconnected from the electronic equipment carried by the arm without removing the hot plug arm from the receptacle. The present invention addresses and solves this problem of conventional plugs.

According to one embodiment of the present invention, a hot plug arm comprises a plug portion inside of which is slidably mounted a connector housing carrying an electrical connector half through which electrical signals may pass. The plug further comprises a lever for sliding the housing between an engagement position, in which the electrical connector half engages a mating electrical connector half in a receptacle, and a non-engagement position where the connector halves are apart.

The plug has retractable nubs on its exterior which engage grooves in the receptacle to retain the plug in the receptacle. Each of the nubs is biased outward to the engagement position by a spring-like backing plate attached to the nub disposed in the interior of the plug near the walls of the slidable housing. When the housing is in the non-engagement position, the nubs and their backing plates are allowed to retract with a modest force to allow the plug to be engaged with or removed from the receptacle. However, when the housing is slid via the lever to the engagement position, the housing walls prevent the nubs from retracting by abutting the backing plates.

Thus, the lever can be operated to engage or disengage the electrical connector halves when the plug and receptacle are engaged, without removing the plug from the receptacle. Furthermore, if the lever is operated to move the housing to the engagement position while the plug and receptacle are engaged, the plug cannot then be removed from the receptacle (since the nubs are locked in engagement with the grooves in the receptacle), thereby providing a positive locking function for the plug and receptacle. Still further, when the housing is in the engagement position and the plug and receptacle are apart, the plug cannot be inserted into the receptacle, because the nubs do not retract to allow insertion, thereby preventing inadvertent electrical connection.

Figure 1A:
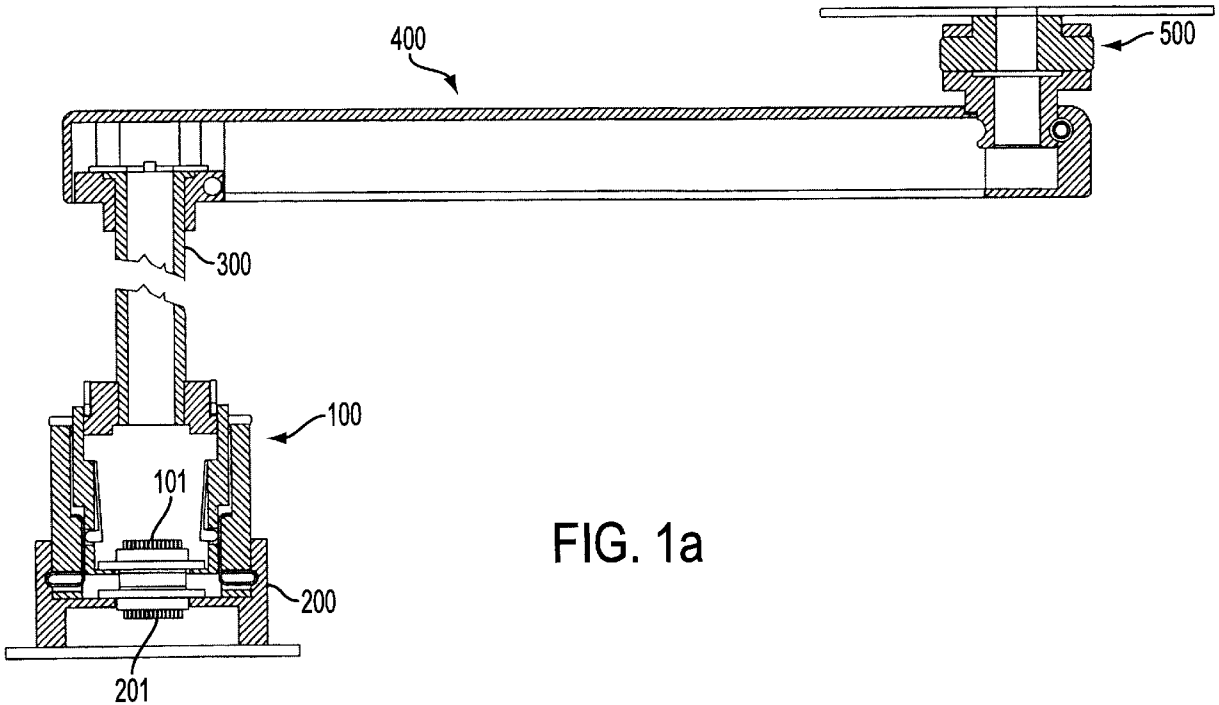
FIG. 1*a* is a cross-sectional view of an apparatus in accordance with an embodiment of the present invention.
Figure 1B:
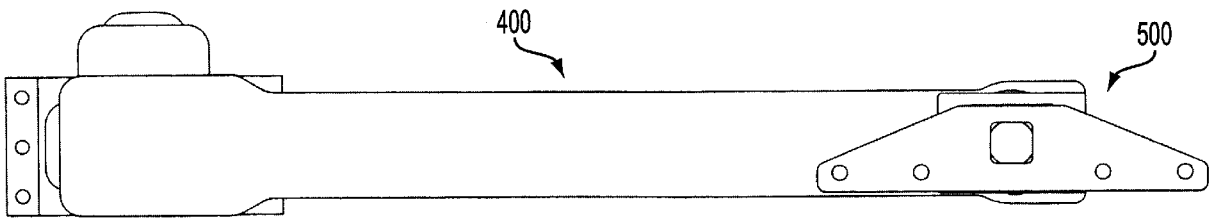
FIGS. 1*b–c* are top and side views, respectively, of an apparatus in accordance with an embodiment of the present invention.
Figure 1C:
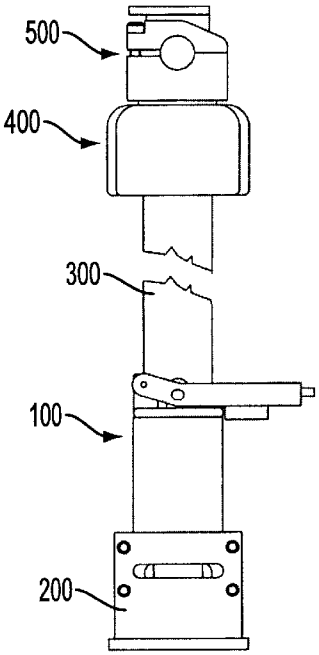
Figure 2:
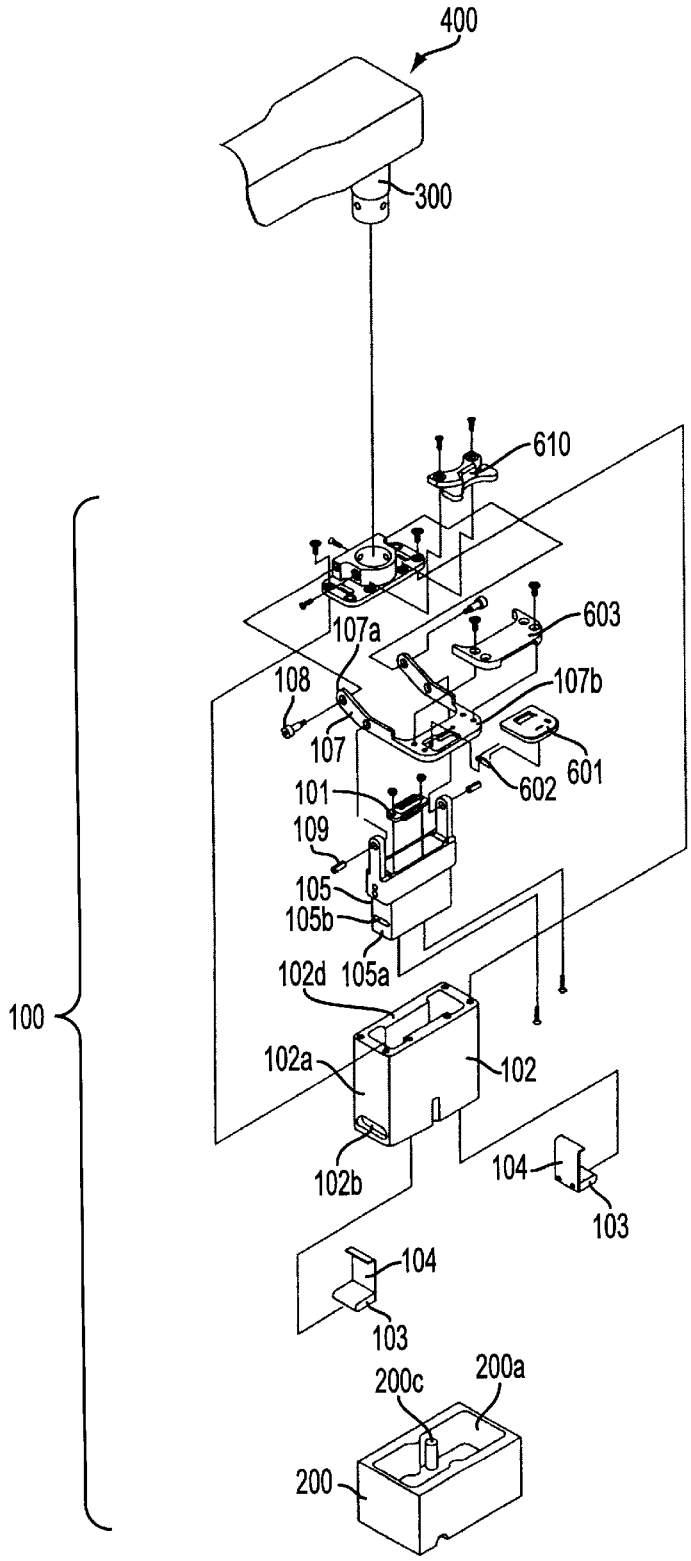
FIG. 2 is an exploded view of an apparatus according to an embodiment of the present invention.

An embodiment of the present invention will now be described in detail with reference to FIGS. 1*a*–5*b*. As shown in FIGS. 1*a*–*c*, a hot plug arm according to this embodiment of the present invention comprises a male plug 100 having an electrical connector portion 101, such as a male electrical connector. Plug 101 is removably engageable with a female receptacle 200 having a second electrical connector portion 201, such as a female electrical connector, which is engageable with male electrical connector portion 101. A hollow shaft 300 is rigidly attached to plug 200 at one end and is pivotably connected to an elongated member 400 at its other end. Elongated member 400 is generally tubular and pivotably connected at one end to a mounting structure 500 for an electronic device, such as a flat-panel monitor (not shown). Elongated member 400 and shaft 300 are configured to allow an electrical cable to be connected to connector portion 101 to pass through their respective interiors from the electronic device. The inventive hot plug arm can also include additional elongated structures (not shown) pivotally mounted between the distal end of elongated member 400 and mounted structure 500. Receptacle 200 is rigidly attachable to a base structure (not shown), such that when plug 100 and receptacle 200 are engaged, they form a coupling for supporting shaft 300, elongated member 400, mounting structure 500 and the monitor.

Figure 3A:
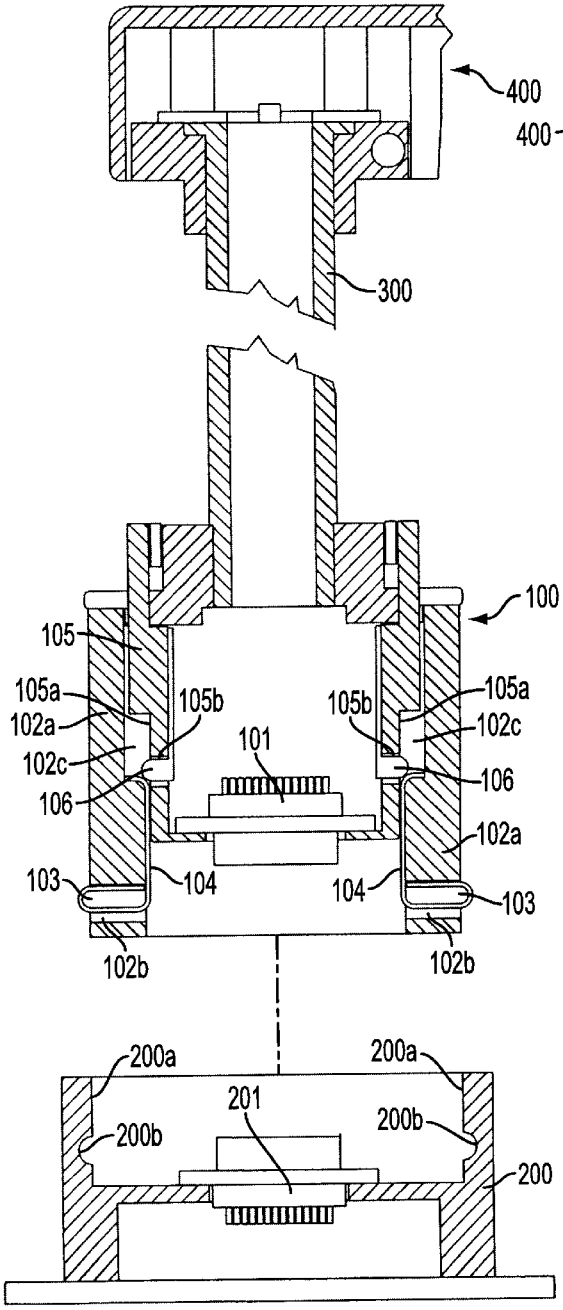
FIG. 3*a* is a cross-sectional view of an apparatus in accordance with an embodiment of the present invention.
Figure 3B:
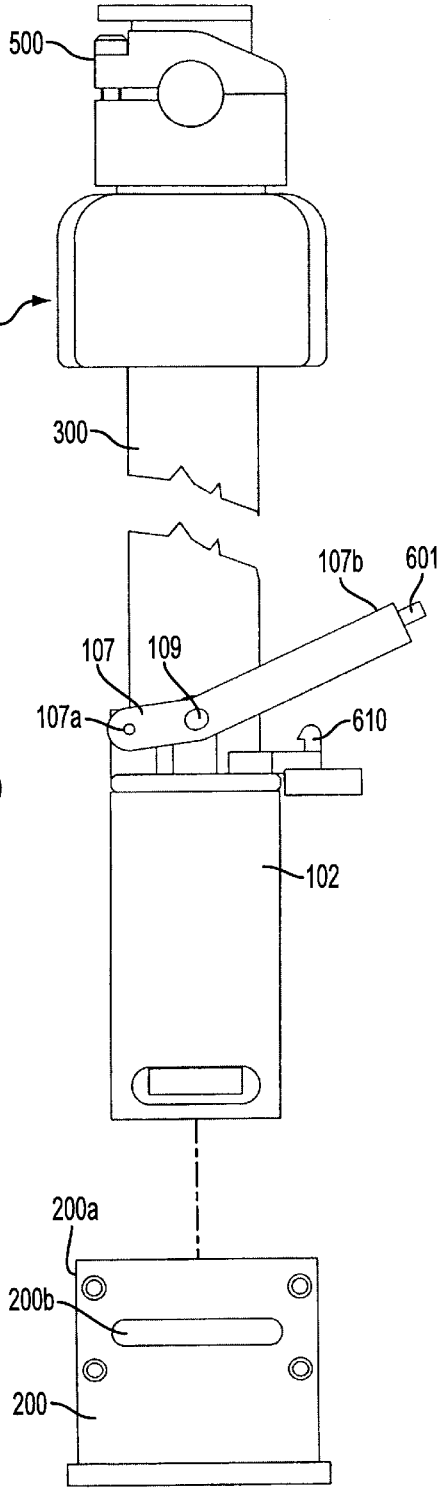
FIG. 3*b* is a side view of an apparatus in accordance with an embodiment of the present invention.
Figure 4A:
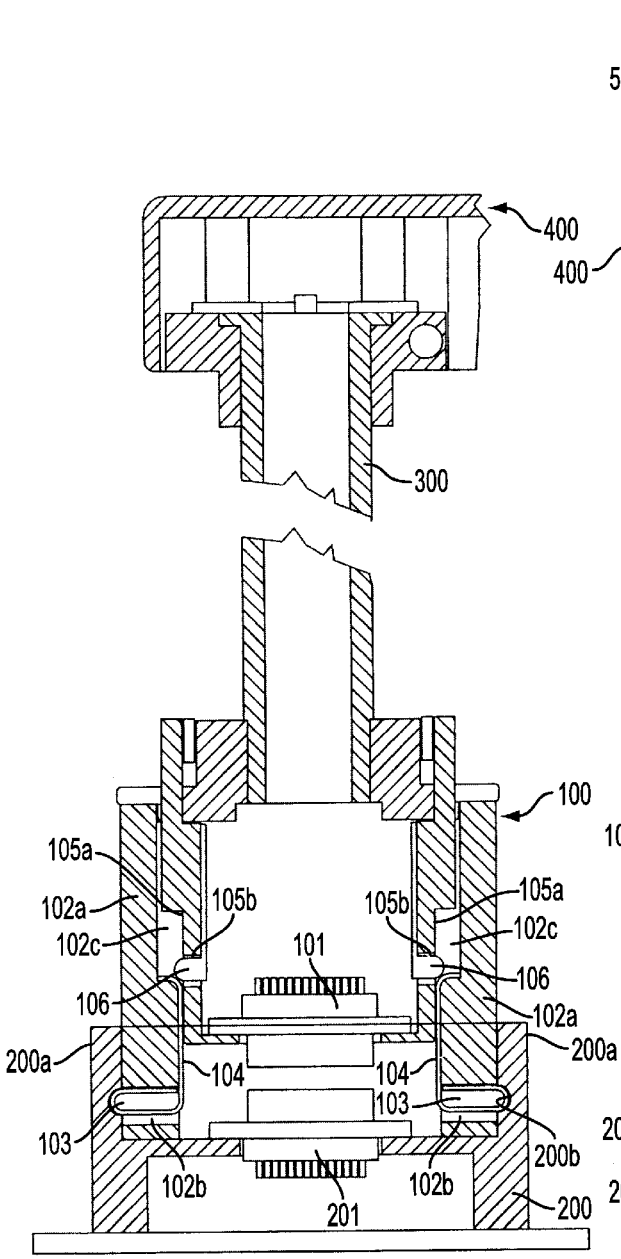
FIG. 4*a* is a cross-sectional view of an apparatus in accordance with an embodiment of the present invention.
Figure 4B:
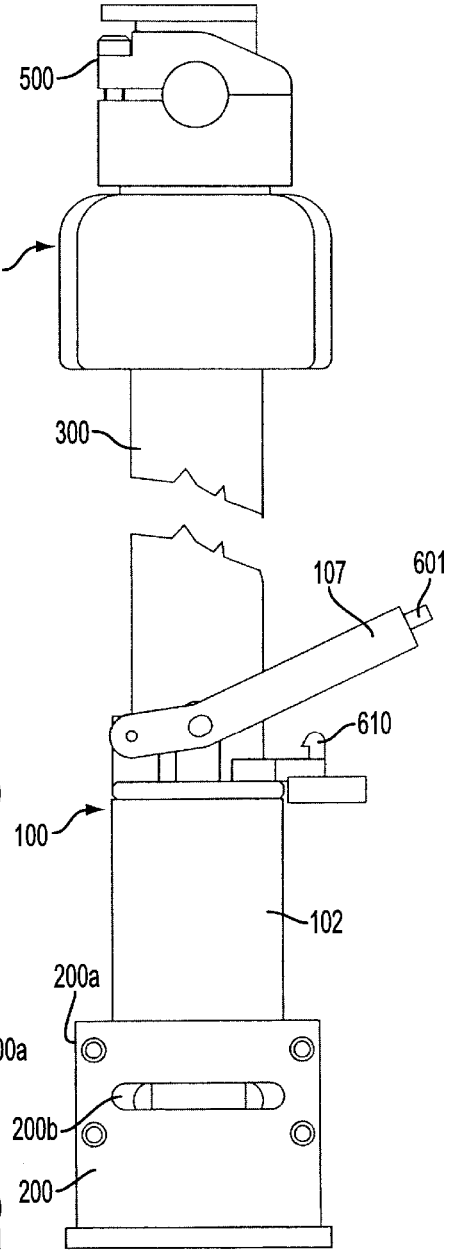
FIG. 4*b* is a side view of an apparatus in accordance with an embodiment of the present invention.

Referring now to FIGS. 2, 3*a*, 3*b* and 4*a*, receptacle 200 comprises a pair of opposing walls 200*a*, each wall 200*a* having a recess 200*b*, which alternatively can be a through-hole as shown in FIG. 3*b*. Plug 100 comprises a plug body 102 having a pair of opposing walls 102*a* which are slidable between receptacle walls 200*a* to engage plug 100 and receptacle 200, and substantially abut receptacle walls 200*a* when plug 100 and receptacle 200 are engaged. Plug body opposing walls 102*a* each have an aperture 102*b* proximal to their bottom end corresponding to a receptacle wall recess 200*b*, and a nub 103 attached to a flat spring 104 mounted to the inside surface of wall 102*a* such that nubs 103 are biased to protrude through apertures 102*b*. Springs 104 allow nubs 103 to retract, thereby allowing plug 100 and receptacle 200 begin to engage, and springs 104 allow nubs 103 to engage receptacle wall recesses 200*b* when plug 100 and receptacle 200 are fully engaged (as shown in FIG. 4*a*). Thus, nubs 103 act to maintain engagement of plug 100 and receptacle 200. Further mechanical stability is provided for the coupling of plug 100 and receptacle 200 by a substantially vertical pin 200*c* mounted in receptacle 200, which fits into a hole in a substantially vertical wall 102*d* in plug body 102.

Figure 5A:
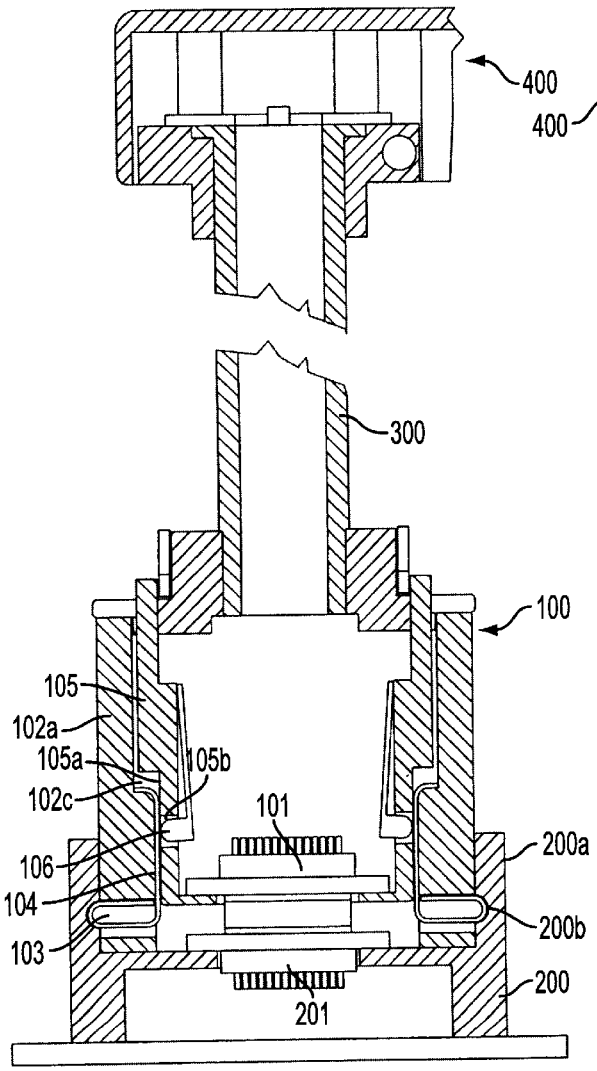
FIG. 5*a* is a cross-sectional view of an apparatus in accordance with an embodiment of the present invention.
Figure 5B:
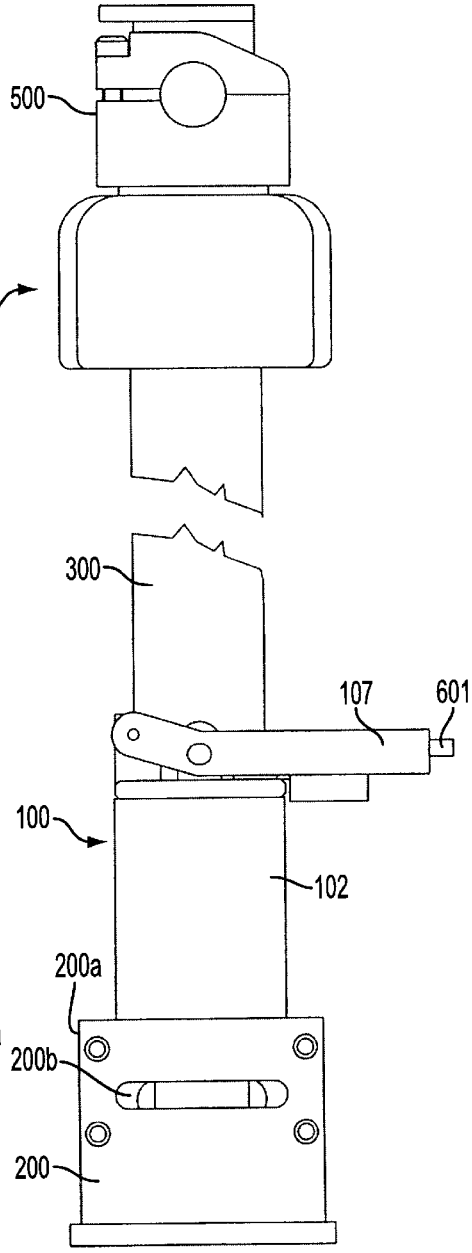
FIG. 5*b* is a side view of an apparatus in accordance with an embodiment of the present invention.
Figure 6A:
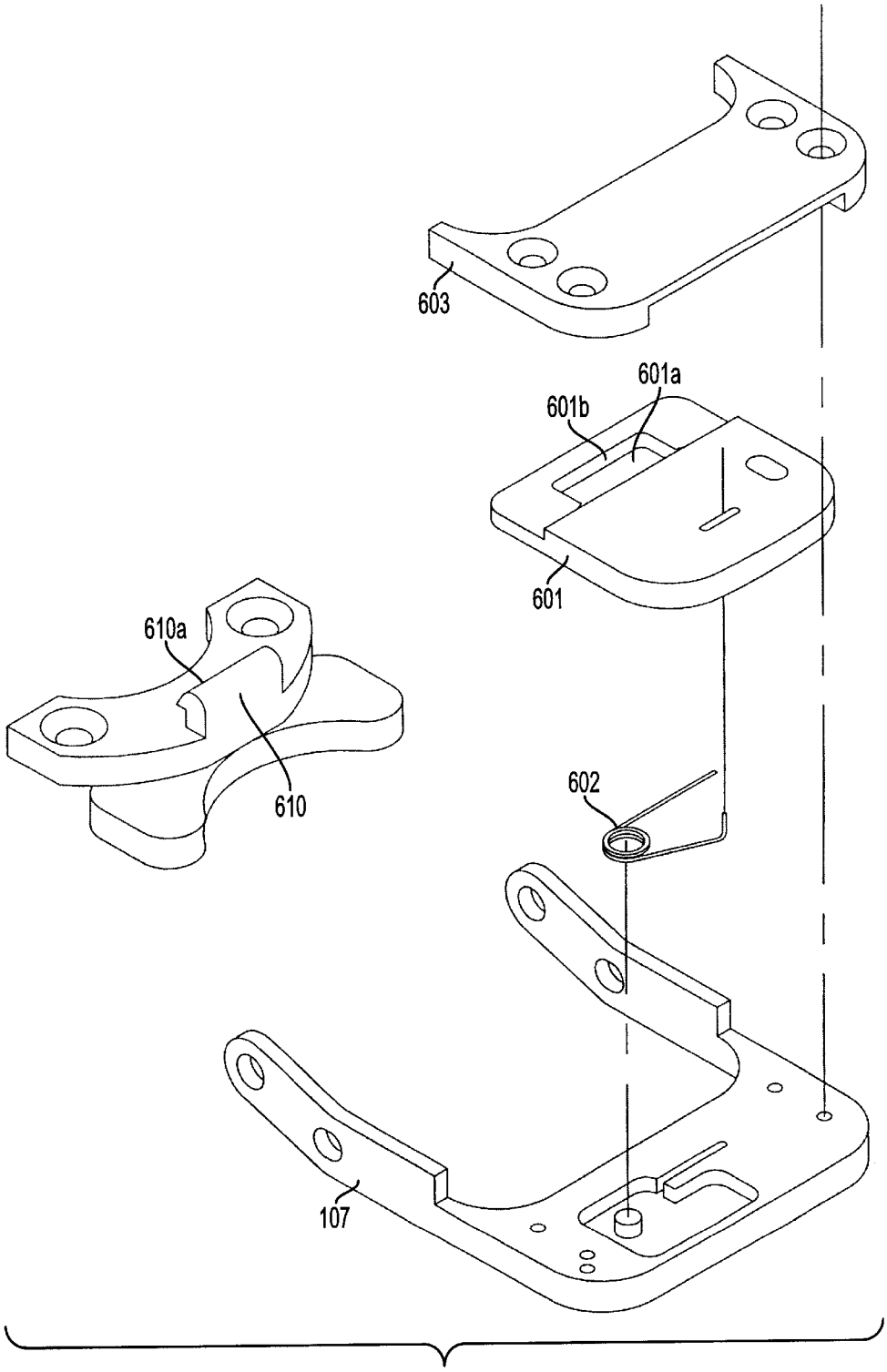
FIG. 6*a* is an exploded view of a locking mechanism in accordance with an embodiment of the present invention.
Figure 6B:
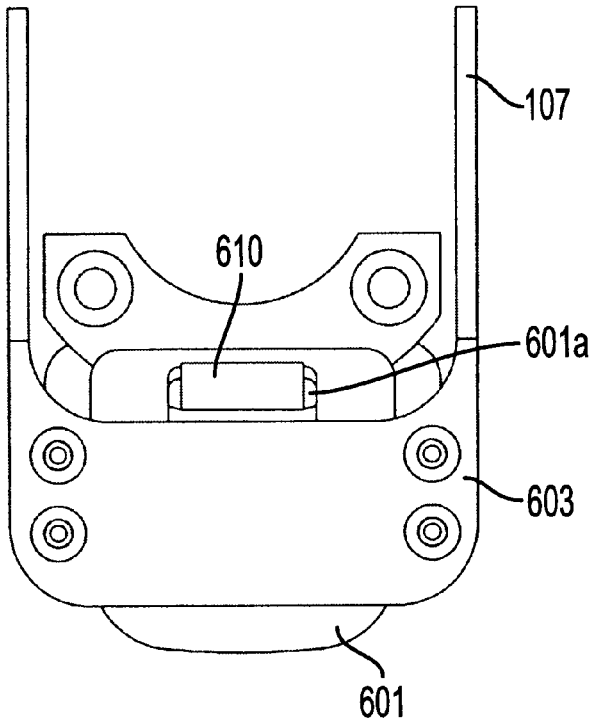
FIG. 6*b* is a top view of a locking mechanism in accordance with an embodiment of the present invention.
Figure 6C:
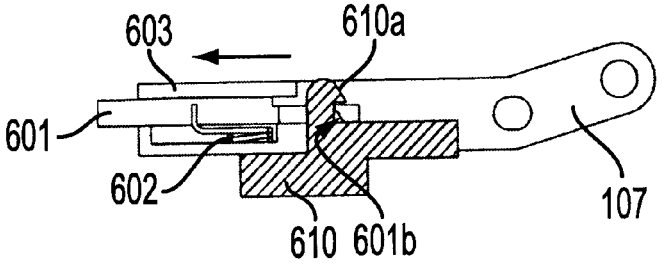
FIG. 6*c* is a cross-sectional view of a locking mechanism in accordance with an embodiment of the present invention.

Plug 100 further comprises a housing 105, to which male connector portion 101 is mounted, having a pair of opposing walls 105*a* slidable between plug body opposing walls 102*a*. Opposing walls 105*a* each have an aperture 105*b* and a retainer 106, such as a plastic spring, biased to protrude through aperture 105*b*. Retainers 106 engage recessed portions 102*c* of plug body opposing walls 102*a* to retain housing 105 in a first position within plug body 102 where connector portions 101 and 201 are disengaged, as depicted, for example, in FIG. 4*a*. A lever 107 is provided for moving housing 105 within plug body 102, lever 107 being pivotably mounted to plug body 102 at a first end 107*a*, as by screws 108, and pivotably mounted to the housing's opposing walls 105*a* between first end 107*a* and a second end 107*b*, as by pins 109. Lever 107 is used to slide housing 105 within plug body 102 between the first position described above and shown in FIG. 4*a* to a second position where connector portions 101 and 201 are engaged, as depicted in FIG. 5*a*. More particularly, when housing 105 is in the first position and lever 107 is pushed downwards, retainers 106 retract to allow housing 105 to slide to the second position.

When the user desires to couple plug 100 and receptacle 200, lever 107 is pulled upward, as shown in FIG. 3*b*, such that retainers 106 engage recessed portions 102*c* of plug walls 102*a* and housing 105 is in the first position (see FIG. 3*a*). Plug body 102 is then inserted into receptacle 200 until nubs 103 engage recesses or slots 200*b* (see FIG. 4*a*). At this point, plug body 102 and receptacle 200 are mechanically coupled and support the monitor via elongated member 400, but the monitor is not electrically connected. Next, lever 107 is pushed down, retainers 106 retract, housing 105 moves to the second position, and connector portions 101, 201 mate to provide an electrical connection to the monitor (see FIGS. 5*a*–*b*). Of course, lever 107 can be pulled up to separate connector portions 101 and 201 and terminate the electrical connection, while plug 100 and receptacle 200 remain coupled.

As shown in FIG. 5*a*, when housing 105 is in the second position, housing walls 105*a* abut springs 104 proximal to nubs 103, preventing nubs 103 from retracting. Consequently, plug 100 and receptacle 200 cannot be disengaged when housing 105 is in the second position. This feature of the present invention provides a positive lock for the plug/receptacle coupling. Likewise, when plug 100 and receptacle 200 are apart, as shown in FIGS. 3*a* and 3*b*, and housing 105 is in the second position (or in any position except the first position), housing walls 105*a* prevent nubs 103 from retracting, thereby preventing plug body 102 from being engaged with receptacle 200. This feature of the present invention prevents inadvertent electrical connection between connector portions 101 and 201, since plug 100 and receptacle 200 must first be physically connected prior to an electrical connection being established.

Next, with reference to FIGS. 3*b*, 4*b*, 5*b* and 6*a*–6*c*, a locking device will be described for positively retaining housing 105 in the second position. The locking device is for engaging lever 107 for substantially immobilizing lever 107 when lever 107 is operated to move housing 105 to the second position. The locking device comprises a push button locking member 601 on lever 107 that incorporates a slot 601 a for engaging a hook 610 attached to plug body 102 for locking lever 107 in the "down" position. A spring 602 between locking member 601 and lever 107 biases locking member 601 towards engagement with hook 610. Plate 603 retains spring 602 and locking member 601 in place on lever 107. A sloped surface 601*b* on locking member 601 and a corresponding sloped surface 610*a* on hook 610 allows locking member 601 to move out of the way to engage hook 610 when lever 107 is pushed down (see FIG. 6*c*). Once hook 610 and locking member 601 are engaged, the bias of spring 602 forces slot 601*a* of locking member 601 under hook 610, locking lever 107 in place. To release lever 107, locking member 601 is pushed towards the centerline of plug body 102, allowing slot 601*a* to clear hook 610 and permit raising of lever 107.

The present invention is applicable to various types of hot plug arms, particularly those for removably mounting electronic equipment such as flat screen monitors for use on airplanes.

The present invention can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present invention. However, it should be recognized that the present invention can be practiced without resorting to the details specifically set forth. In other instances, well known processing structures have not been described in detail, in order not to unnecessarily obscure the present invention.

Only the preferred embodiment of the present invention and but a few examples of its versatility are shown and described in the present disclosure. It is to be understood that the present invention is capable of use in various other combinations and environments and is capable of changes or modifications within the scope of the inventive concept as expressed herein.

What is claimed is:

1. An apparatus comprising:

a first electrical connector portion;

a second electrical connector portion for engaging with the first electrical connector portion to establish an electrical connection;

a receptacle for mounting the first electrical connector portion; and a plug for engaging the receptacle such that the receptacle and plug form a substantially rigid coupling when engaged, the plug comprising a housing for mounting the second electrical connector portion, the housing being movable from a first position where the first and second electrical connector portions are disengaged to a second position where the first and second electrical connector portions are engaged;

wherein the plug and receptacle are engageable only when the housing is in the first position;

wherein the receptacle is rigidly attachable to a first structure, and the coupling is for pivotably supporting a second structure attached to the plug; and wherein the second structure comprises a tubular arm pivotably mounted to the plug and the tubular arm is configured to allow an electrical cable to pass through its interior.

2. The apparatus of claim 1, wherein the plug comprises a plug body, and the housing is slidably mounted to the plug body, the apparatus further comprising a lever for moving the housing between the first and second positions, the lever having a first end and a second end, the lever being pivotably mounted to the plug body at the first end, and the lever being pivotably mounted to the housing between the first and second ends.

3. The apparatus of claim 1, wherein the tubular arm pivotably mounted to the plug is for supporting an electronic display unit.

4. The apparatus of claim 1, wherein the plug and receptacle cannot be disengaged when the housing is in the second position.

5. An apparatus comprising:

a first electrical connector portion;

a second electrical connector portion for engaging with the first electrical connector portion to establish an electrical connection;

a receptacle for mounting the first electrical connector portion; and a plug for engaging the receptacle such that the receptacle and plug form a substantially rigid coupling when engaged, the plug comprising a housing for mounting the second electrical connector portion, the housing being movable from a first position where the first and second electrical connector portions are disengaged to a second position where the first and second electrical connector portions are engaged;

wherein the plug and receptacle are engageable only when the housing is in the first position;

wherein the plug and receptacle cannot be disengaged when the housing is in the second position;

wherein the receptacle comprises a pair of opposing walls, each wall having a recess, and the plug comprises a plug body having a pair of opposing walls which correspond to and substantially abut the receptacle's pair of opposing walls when the plug and the receptacle are engaged; and wherein the plug body opposing walls each have an aperture and a nub biased to protrude through the aperture such that the nubs retract to allow the plug body walls and the receptacle walls to begin engaging, and the nubs engage the recesses of the corresponding walls of the receptacle when the plug and the receptacle are fully engaged, to maintain engagement of the plug and receptacle.

6. The apparatus of claim 5, wherein the recesses are through-holes in the receptacle's opposing walls.

7. The apparatus of claim 5, wherein the plug body opposing walls are slidable between the receptacle's opposing walls, and the housing comprises a pair of opposing walls slidable between the plug body opposing walls.

8. The apparatus of claim 7, wherein when the housing is in the second position, the housing prevents the nubs from retracting.

9. The apparatus of claim 8, wherein the nubs each comprise a flat spring for biasing the nub to protrude through the plug body wall aperture, and the housing abuts the flat spring proximal to the nub when the housing is in the second position to prevent the nub from retracting.

10. The apparatus of claim 5, further comprising a lever for moving the housing between the first and second positions, the lever having a first end and a second end, the lever being pivotably mounted to the plug body at the first end, the lever being pivotably mounted to one of the housing's opposing walls between the first and second ends.

11. The apparatus of claim 10, wherein the plug body opposing walls each have a recessed portion; wherein the housing opposing walls each have an aperture and a retainer biased to protrude through the aperture such that the retainers engage the recessed portions of the plug body opposing walls to retain the housing in the first position, and wherein the retainers retract when the lever is operated to allow the housing to slide to the second position.

12. The apparatus of claim 10, further comprising a locking device for positively retaining the housing in the second position.

13. The apparatus of claim 12, wherein the locking device engages the lever for substantially immobilizing the lever when the lever is operated to move the housing to the second position.

14. The apparatus of claim 13, wherein the locking device comprises a hook rigidly mounted to the plug body and a locking member movably mounted to the lever such that the hook and locking member engage to retain the lever in place when the lever is operated to move the housing to the second position.

15. The apparatus of claim 14, further comprising a spring between the locking member and the lever for biasing the locking member towards engagement with the hook when the housing is in the second position, and a push button for moving the locking member to disengage the locking member and the hook.

16. An apparatus comprising:

a first electrical connector portion;

a second electrical connector portion for engaging with the first electrical connector portion to establish an electrical connection;

a receptacle for mounting the first electrical connector portion; and a plug for engaging the receptacle such that the receptacle and plug form a substantially rigid coupling when engaged, the plug comprising a housing for mounting the second electrical connector portion, the housing being movable from a first position where the first and second electrical connector portions are disengaged to a second position where the first and second electrical connector portions are engaged;

wherein the plug and receptacle are engageable only when the housing is in the first position;

wherein the receptacle comprises a substantially vertical pin, and the plug body comprises a substantially vertical wall having a hole for receiving the pin when the plug and receptacle are engaged, wherein the pin is for providing mechanical stability to the coupling.

17. An apparatus comprising:

a first electrical connector portion;

a second electrical connector portion for engaging with the first electrical connector portion to establish an electrical connection;

a receptacle for mounting the first electrical connector portion; and a plug for engaging the receptacle such that the receptacle and plug form a substantially rigid coupling when engaged, the plug comprising a housing for mounting the second electrical connector portion;

wherein the first and second electrical connector portions are engageable only after the plug and receptacle are engaged;

wherein the receptacle is rigidly attachable to a first structure, and the coupling is for pivotably supporting a second structure attached to the plug; and wherein the second structure comprises a tubular arm pivotably mounted to the plug and the tubular arm is configured to allow an electrical cable to pass through its interior.

* * * * *